US007399064B2

(12) United States Patent
Fowler et al.

(10) Patent No.: US 7,399,064 B2
(45) Date of Patent: Jul. 15, 2008

(54) INK JETTING ASSEMBLY

(75) Inventors: John Richard Fowler, Nicholasville, KY (US); Ganesh Vinayak Phatak, Lexington, KY (US); Matthew Joe Russell, Stamping Ground, KY (US); Jeffrey Louis Sangalli, Louisville, KY (US); Joseph Andrew Schaefer, Lexington, KY (US); David Amos Ward, Cynthiana, KY (US)

(73) Assignee: Lexmark International, Inc., Lexington, KY (US)

( * ) Notice: Subject to any disclaimer, the term of this patent is extended or adjusted under 35 U.S.C. 154(b) by 395 days.

(21) Appl. No.: 11/303,274

(22) Filed: Dec. 16, 2005

(65) Prior Publication Data

US 2007/0139478 A1 Jun. 21, 2007

(51) Int. Cl.
*B41J 2/04* (2006.01)

(52) U.S. Cl. ..... 347/54; 401/194

(58) Field of Classification Search ..... 347/20, 347/44, 47, 54, 56–59, 61–65, 67; 346/33 R, 346/116, 119, 139 R, 140.1, 139 C; 401/194, 401/195, 28, 47, 52, 45
See application file for complete search history.

(56) References Cited

U.S. PATENT DOCUMENTS

| | | | | |
|---|---|---|---|---|
| 5,980,719 | A * | 11/1999 | Cherukuri et al. | 347/20 |
| 6,550,997 | B1 | 4/2003 | King et al. | 401/45 |
| 2004/0052569 | A1 | 3/2004 | Bich et al. | 401/194 |

* cited by examiner

*Primary Examiner*—Juanita D Stephens
(74) *Attorney, Agent, or Firm*—Taylor & Aust, PC

(57) ABSTRACT

An ink jetting assembly includes a body, and an ink jet chip attached to the body. The ink jet chip has a mounting surface, a face surface, an ink channel extending to the face surface, and at least one actuator associated with the ink channel. The actuator includes a plurality of electrical contact pads formed on the face surface. A plurality of passageways extends through the ink jet chip from the mounting surface to the face surface. The ink jetting assembly also includes a plurality of electrodes. Each of the plurality of electrodes passes through a respective passageway of the plurality of passageways and is electrically connected to a respective contact pad of the plurality of electrical contact pads at the face surface.

18 Claims, 6 Drawing Sheets

INK JETTING ASSEMBLY

BACKGROUND OF THE INVENTION

1. Field of the Invention

The present invention relates to ink jet printing, and, more particularly, to an ink jetting assembly.

2. Description of the Related Art

A traditional ink writing instrument, such as a ball-point ink pen, includes a tubular structure containing a supply of ink in fluid communication with a roller-ball writing tip. More recently, a writing instrument has been developed that includes a liquid ink reservoir for containing liquid ink, and a spray head for spraying the liquid ink. In operation, a detector mechanism sends a signal to a processor unit to activate spraying of the liquid ink.

Traditional ink jet cartridge design and manufacturing processes do not adequately facilitate features that are consistent with a small and compact design, so as to accommodate, for example, a writing instrument application. For example, typical ink jet cartridge designs require internal and external walls around the heater chip in order to hold the thermally cured adhesive that is used for sealing the heater chip to the cartridge body, and require an external folded flexible circuit for electrical interconnection between the heater chip and the driving electronics. Accordingly, current ink jet cartridge design and manufacturing technology would yield a printhead size that is larger than would be expected by and/or acceptable to a typical user for use in a writing instrument.

SUMMARY OF THE INVENTION

The invention, in one exemplary embodiment, is directed to an ink jetting assembly. The ink jetting assembly includes a body, and an ink jet chip attached to the body. The ink jet chip has a mounting surface, a face surface, an ink channel extending to the face surface, and at least one actuator associated with the ink channel. The actuator includes a plurality of electrical contact pads formed on the face surface. A plurality of passageways extends through the ink jet chip from the mounting surface to the face surface. The ink jetting assembly also includes a plurality of electrodes. Each of the plurality of electrodes passes through a respective passageway of the plurality of passageways and is electrically connected to a respective contact pad of the plurality of electrical contact pads at the face surface.

The invention, in another exemplary embodiment, is directed to an ink jetting assembly. The ink jetting assembly includes a plastic body forming an ink reservoir and having a seal surface. An ink jet chip has a mounting surface coupled to the seal surface of the plastic body, a face surface, and an ink channel extending to the face surface. At least one actuator is associated with the ink channel. The actuator includes a plurality of electrical contact pads formed on the face surface. A plurality of passageways extends through the ink jet chip from the mounting surface to the face surface. A nozzle plate has a base surface, an outer surface, and at least one ink jetting nozzle. The base surface of the nozzle plate is attached to the face surface of the ink jet chip, and the ink jetting nozzle is in fluid communication with the ink channel of the ink jet chip. The nozzle plate has a plurality of openings extending through the nozzle plate from the base surface to the outer surface. A plurality of electrodes is provided. Each of the plurality of electrodes passes through a respective passageway of the plurality of passageways of the ink jet chip, and each of the plurality of electrodes is received in a respective opening of the plurality of openings of the nozzle plate. A conductive bonding material is applied into each of the plurality of openings to electrically connect each electrode of the plurality of electrodes to a respective contact pad of the plurality of electrical contact pads at the face surface of the ink jet chip.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

The present invention is directed to an ink jetting assembly, which will be described below with respect to two primary exemplary embodiments. One exemplary embodiment is directed to a writing instrument 10, and a second exemplary embodiment is directed to a unitary ink jet printhead cartridge 12, which may be utilized in conjunction with writing instrument 10.

Figure 1:
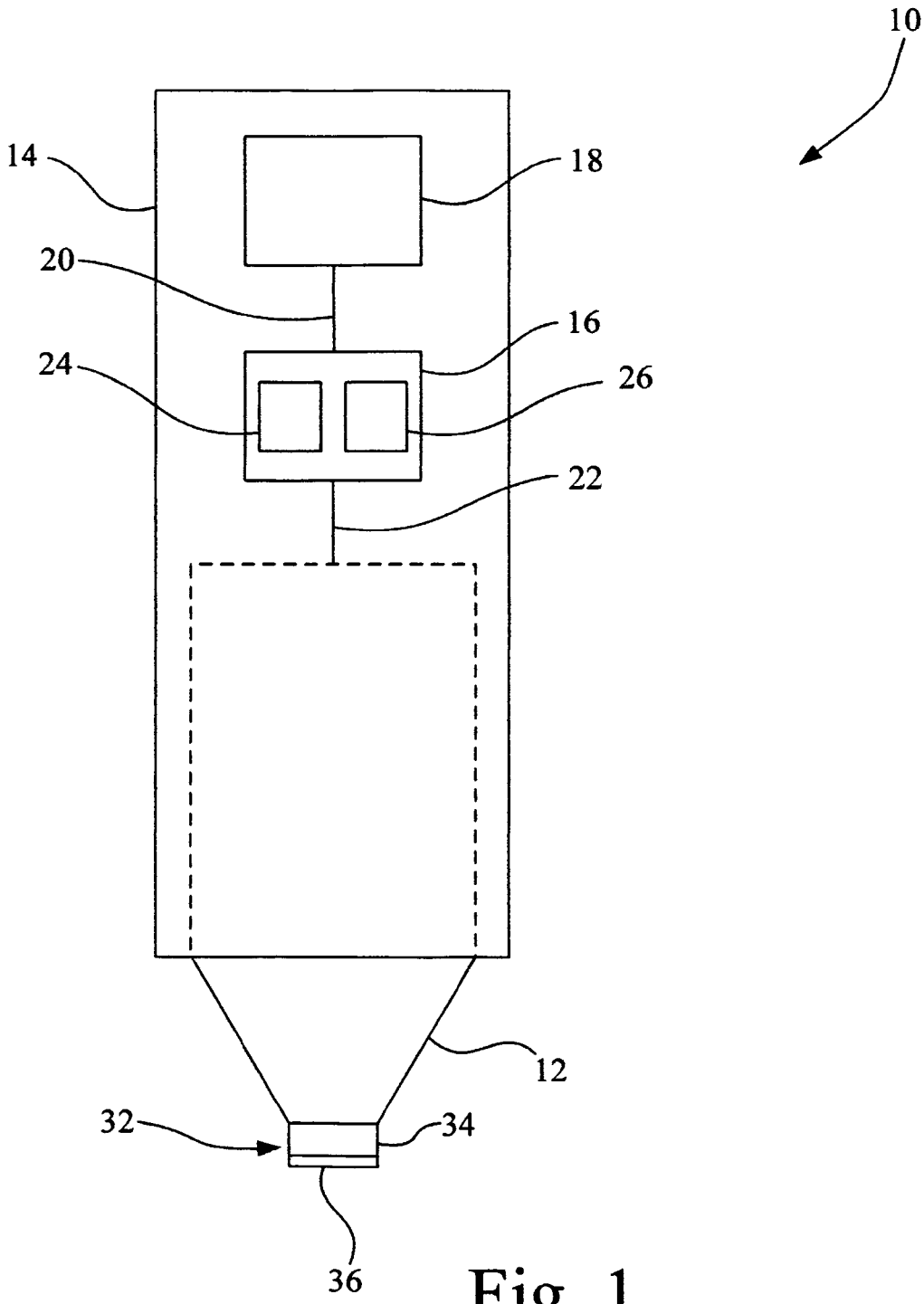
FIG. 1 is a diagrammatic representation of a writing instrument configured in accordance with an embodiment of the present invention.

Referring now to the drawings, and particularly to FIG. 1, there is shown a diagrammatic representation of a writing instrument 10 configured in accordance with an embodiment of the present invention. Writing instrument 10 includes a barrel portion 14 that may be configured for replaceably mounting unitary ink jet printhead cartridge 12, in which case ink jet printhead cartridge 12 is configured as a unitary replaceable ink jet printhead cartridge. Alternatively, barrel portion 14 may configured for permanently mounting the unitary ink jet printhead cartridge 12.

Writing instrument 10 includes a control circuit 16 and a power source 18. Power source 18 may be, for example, a battery or solar cell. Power source 18 is connected to control circuit 16 via a power cable 20. Control circuit 16 is communicatively coupled to ink jet printhead cartridge 12 via a communications link 22. Communications link 22 may be a wired connection, or alternatively, a wireless connection.

Control circuit 16 includes, for example, a processor unit 24 and an input unit 26. Processor unit 24 may be an application specific integrated circuit (ASIC) that processes input signals received from input unit 26 to control ink jet printhead cartridge 12 to selectively eject ink. Input unit 26 may include, for example, a sensor unit that, when actuated by sensing a predetermined distance to a surface, provides input signals to processor unit 24. As an alternative to, or in addition to, the sensor unit, input unit 26 may include a manual control button for providing input signals to processor unit 24.

Figure 2:
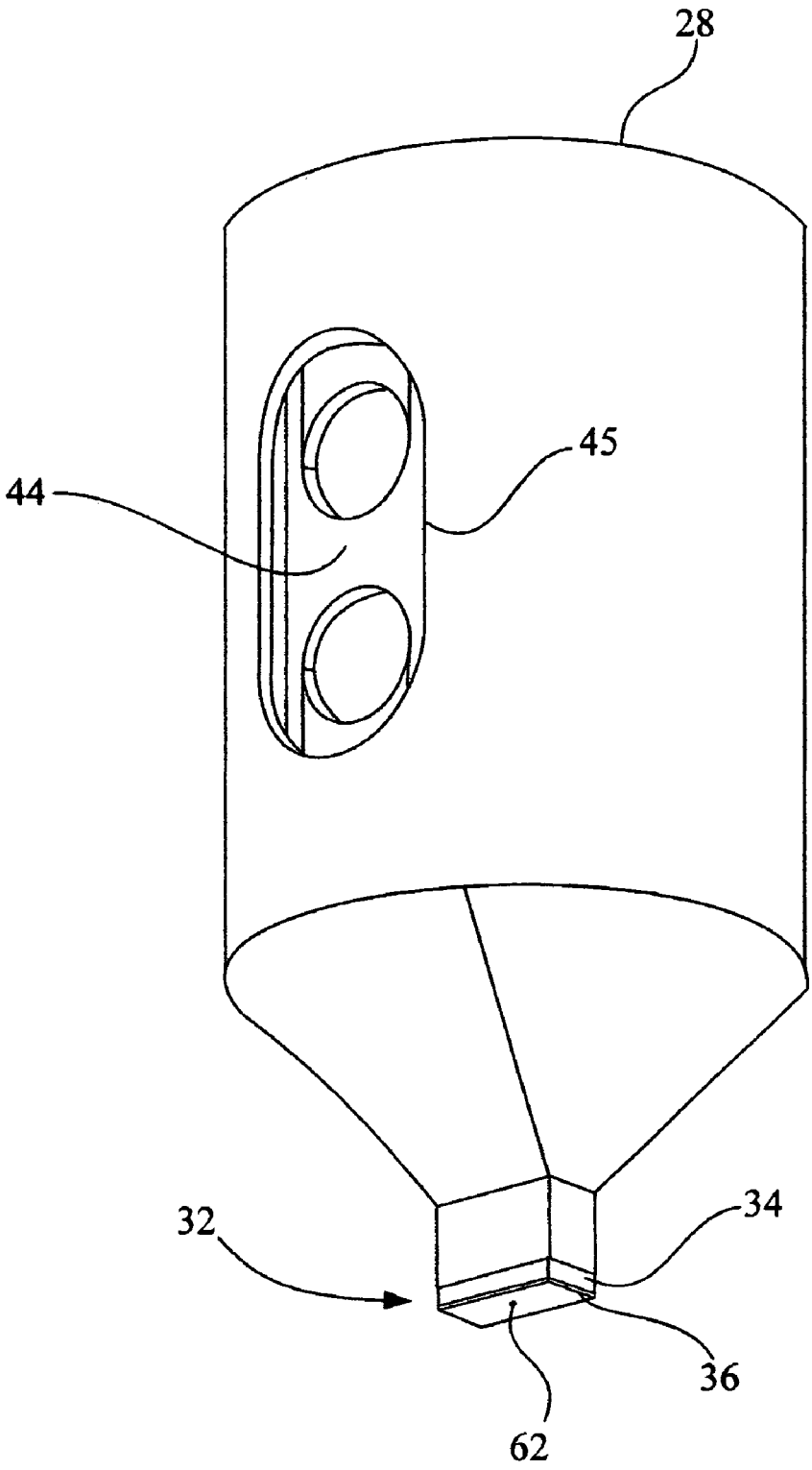
FIG. 2 is a perspective view of an embodiment of an ink jet printhead cartridge suitable for use in the writing instrument of FIG. 1.
Figure 3:
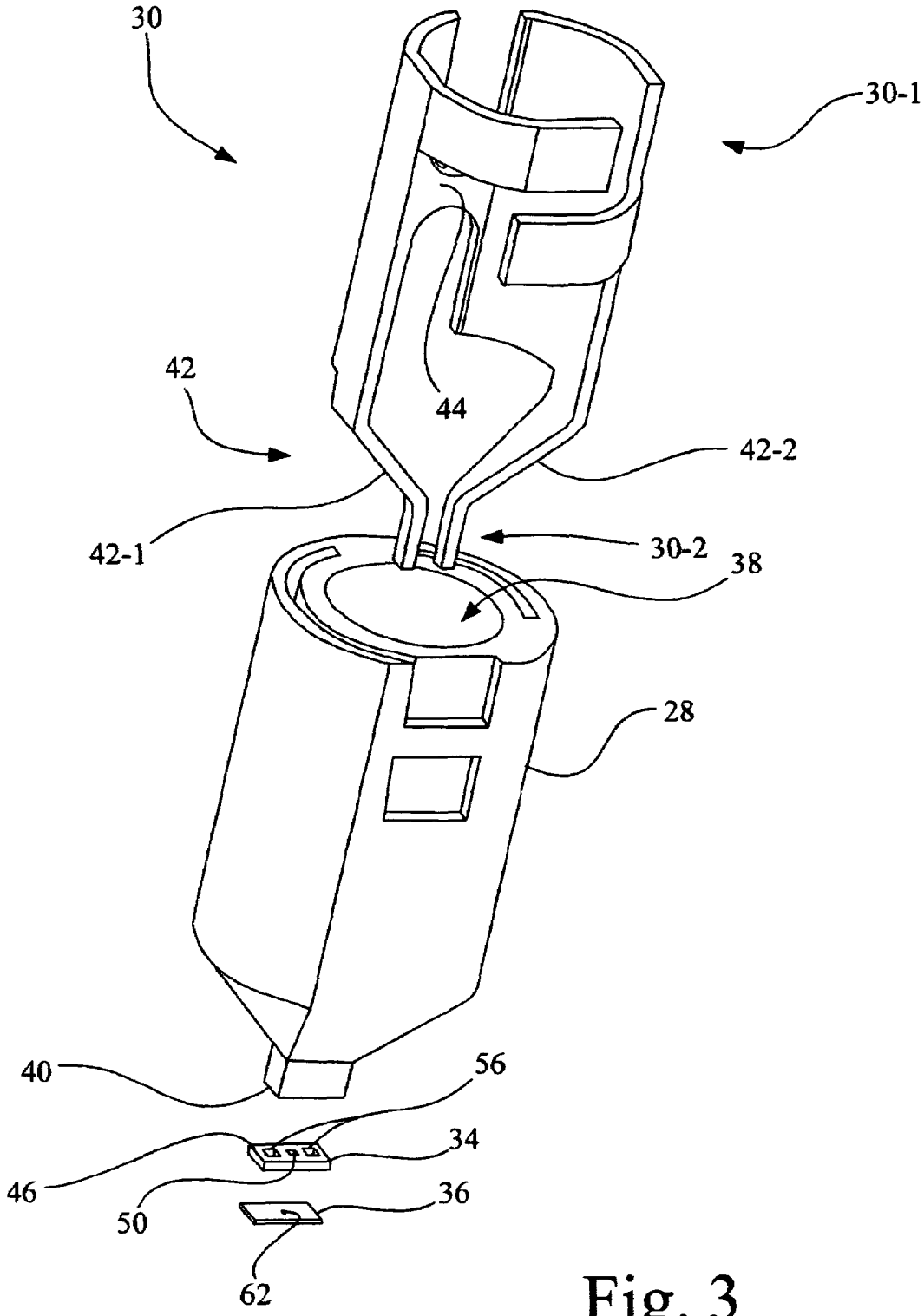
FIG. 3 is an exploded view of the embodiment of the ink jet printhead cartridge of FIG. 2.

FIG. 2 is an a perspective view of an embodiment of ink jet printhead cartridge 12, and FIG. 3 is an exploded view of the embodiment of ink jet printhead cartridge 12. Ink jet printhead cartridge 12 includes a body 28, a lead (or other suitable frame material) frame 30 and a printhead 32. Printhead 32 includes an ink jet chip 34 and a nozzle plate 36. Ink jet chip 34 may be formed, for example, from a silicon wafer. Nozzle plate 36 may be formed, for example, from a polyamide material.

Body 28 may be made, for example, from plastic. Body 28 forms an ink reservoir 38 for containing a supply of ink, and has a seal surface 40.

Lead frame 30 includes a plurality of electrodes 42, individually identified as electrode 42-1 and electrode 42-2. Lead frame 30 has a proximal end 30-1 and a distal end 30-2.

Figure 4:
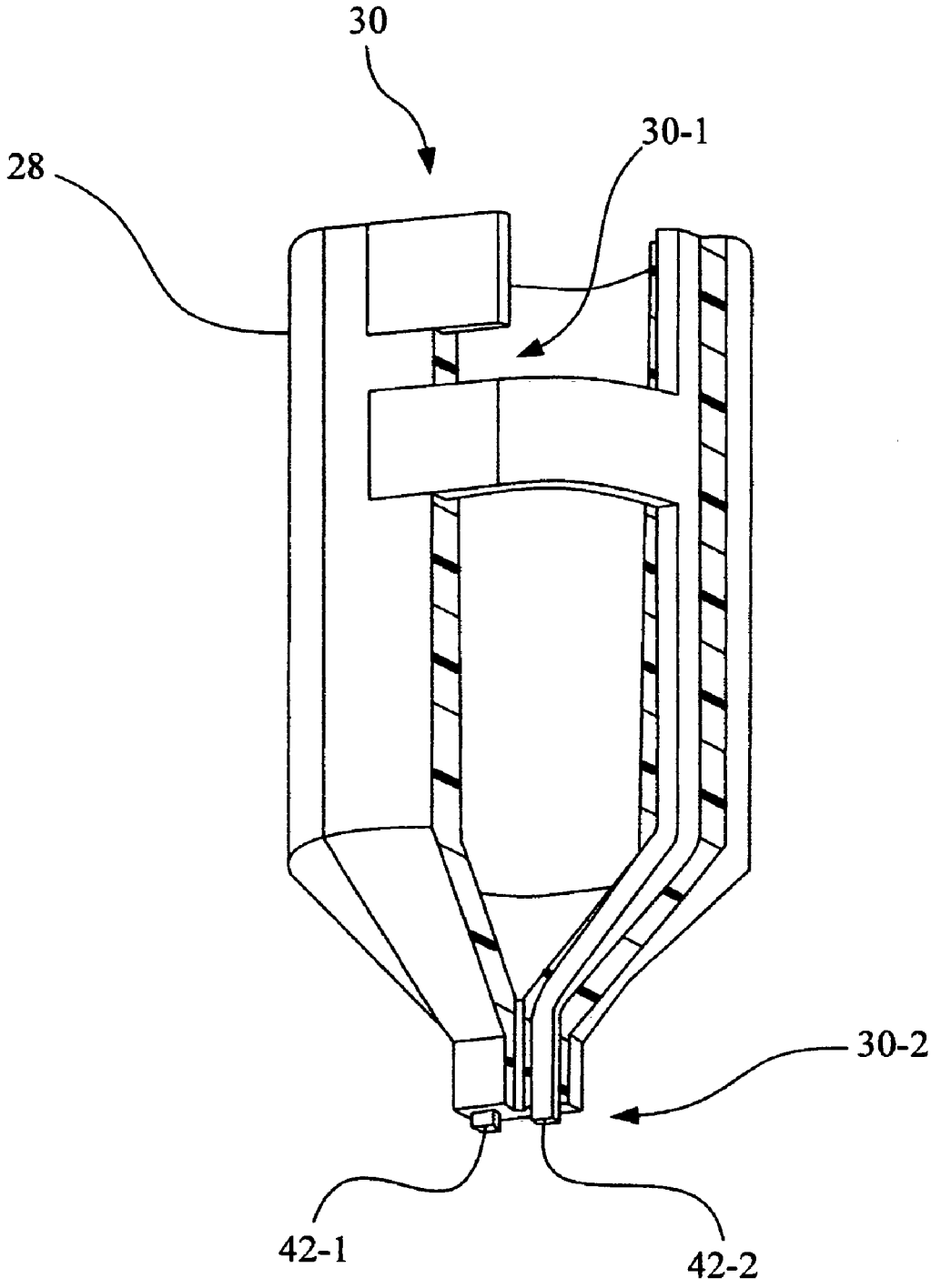
FIG. 4 is a sectioned perspective view of the body of the embodiment of the ink jet printhead cartridge of FIG. 2, with the printhead removed.

As a manufacturing aid, lead frame 30 may be initially formed as a unitary device having a bridge structure 44 that interconnects the plurality of electrodes 42 as a single piece. As shown in FIG. 4, which is a sectioned perspective view of the body 28, the unitary lead frame 30, including the plurality of electrodes 42, may be insert molded with the plastic body 28. As shown in FIG. 2, body 28 includes an access opening 45 that permits access to bridge structure 44 of lead frame 30. The plurality of electrodes 42 are separated into individual electrodes, e.g., cut into individual electrodes 42-1 and 42-2, following the insert molding process by cutting bridge structure 44.

As shown in FIG. 4, the proximal ends 30-1 of electrodes 42-1 and 42-2 are accessible from outside body 28 to facilitate connection to a drive circuit, such as control circuit 16. Also, the distal ends 30-2 of electrodes 42-1 and 42-2 of the plurality of electrodes 42 extend outwardly from seal surface 40 to facilitate connection to ink jet chip 34. Further, a central portion of electrodes 42-1 and 42-2 is encased in plastic body 28, and thus electrically insulated.

An exemplary alternative to insert molding lead frame 30 with plastic body 28 would be to place lead frame 30 on a molded plastic body and then over-mold an exterior shell around the entire assembly.

Another exemplary alternative to insert molding lead frame 30 with plastic body 28 would be to mount lead frame 30 external to plastic body 28, and rely on barrel portion 14 of writing instrument 10, assuming it is plastic, to provide electrical insulation for the side surfaces of the plurality of electrodes 42.

Figure 5:
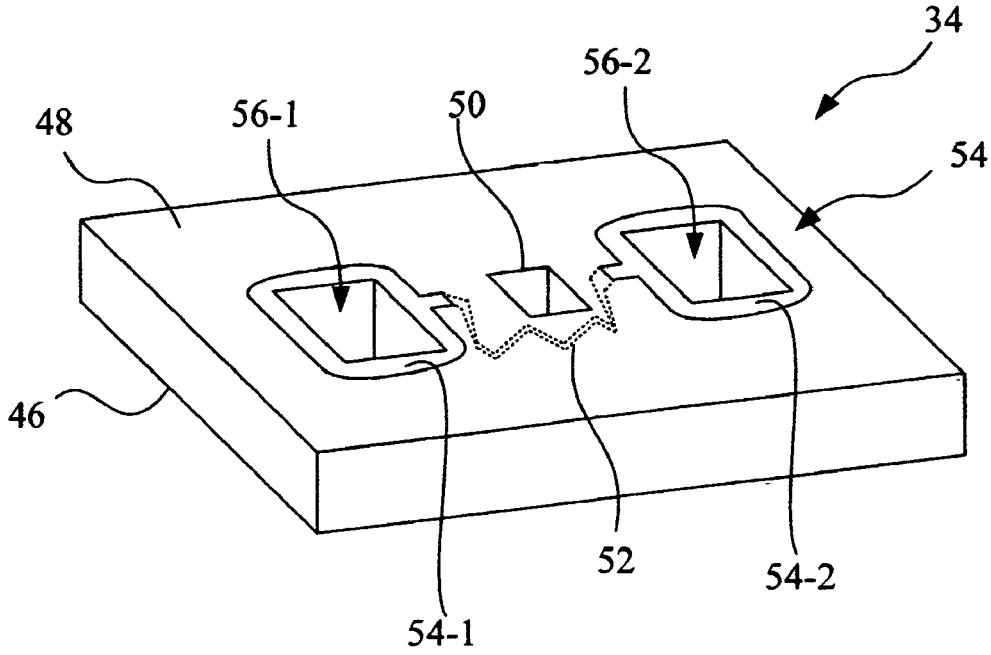
FIG. 5 is an enlarged diagrammatic representation of the ink jet chip of the embodiment shown in FIG. 3.

Referring to FIGS. 3 and 5, ink jet chip 34 includes a mounting surface 46, a face surface 48 and an ink channel 50 extending to face surface 48 from mounting surface 46. The orientation of ink jet chip 34 shown in FIG. 5 is flipped with respect to the orientation of ink jet chip 34 shown in FIG. 3 so that both surfaces 46, 48 may be observed. Ink jet chip 34 further includes at least one actuator 52, e.g., an electrical heater or piezoelectric device, (schematically illustrated) associated with ink channel 50. Actuator 52 includes a plurality of electrical contact pads 54, individually identified as contact pad 54-1 and contact pad 54-2, formed on face surface 48.

A plurality of passageways 56, individually identified as passageway 56-1 and passageway 56-2, extend through ink jet chip 34 from mounting surface 46 to face surface 48 in close proximity to contact pads 54-1 and 54-2. In one embodiment, for example, each contact pad 54-1, 54-2 of the plurality of electrical contact pads 54 surrounds a respective passageway 56-1, 56-2. Ink channel 50 and the plurality of passageways 56 may be formed, for example, by a deep reactive-ion etching (DRIE) process.

Figure 6:
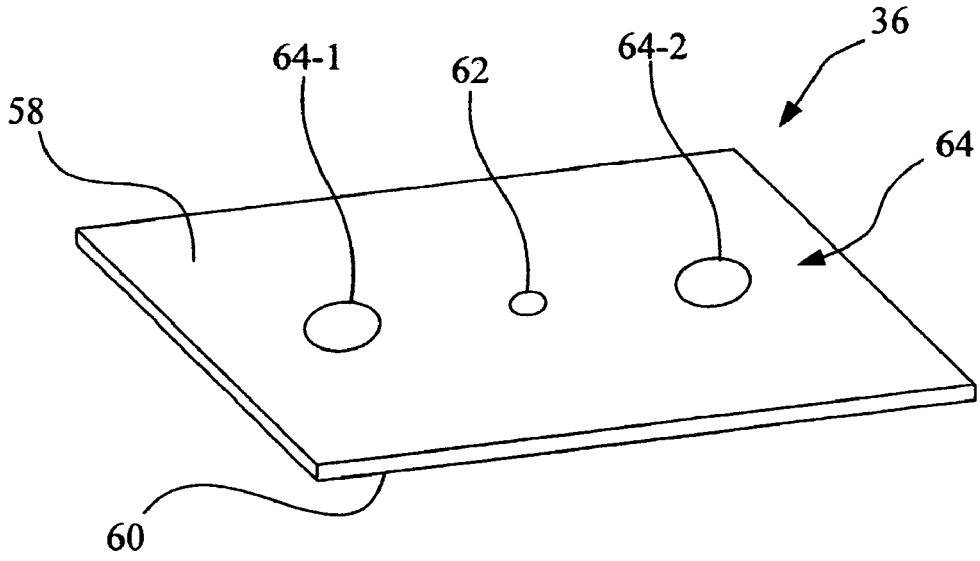
FIG. 6 is an enlarged view of the nozzle plate of the embodiment shown in FIG. 3.

Referring to FIGS. 3 and 6, nozzle plate 36 has a base surface 58, an outer surface 60, and at least one ink jetting nozzle 62. Ink jetting nozzle 62 extends through nozzle plate 36 from base surface 58 to outer surface 60. In one embodiment, nozzle plate 36 also includes a plurality of openings 64, individually identified as opening 64-1 and opening 64-2, which extend through nozzle plate 36 from base surface 58 to outer surface 60. Ink jetting nozzle 62, and the plurality of openings 64, may be formed in nozzle plate 36 by laser ablation, when nozzle plate 36 is formed from a polyamide material.

Figure 7:
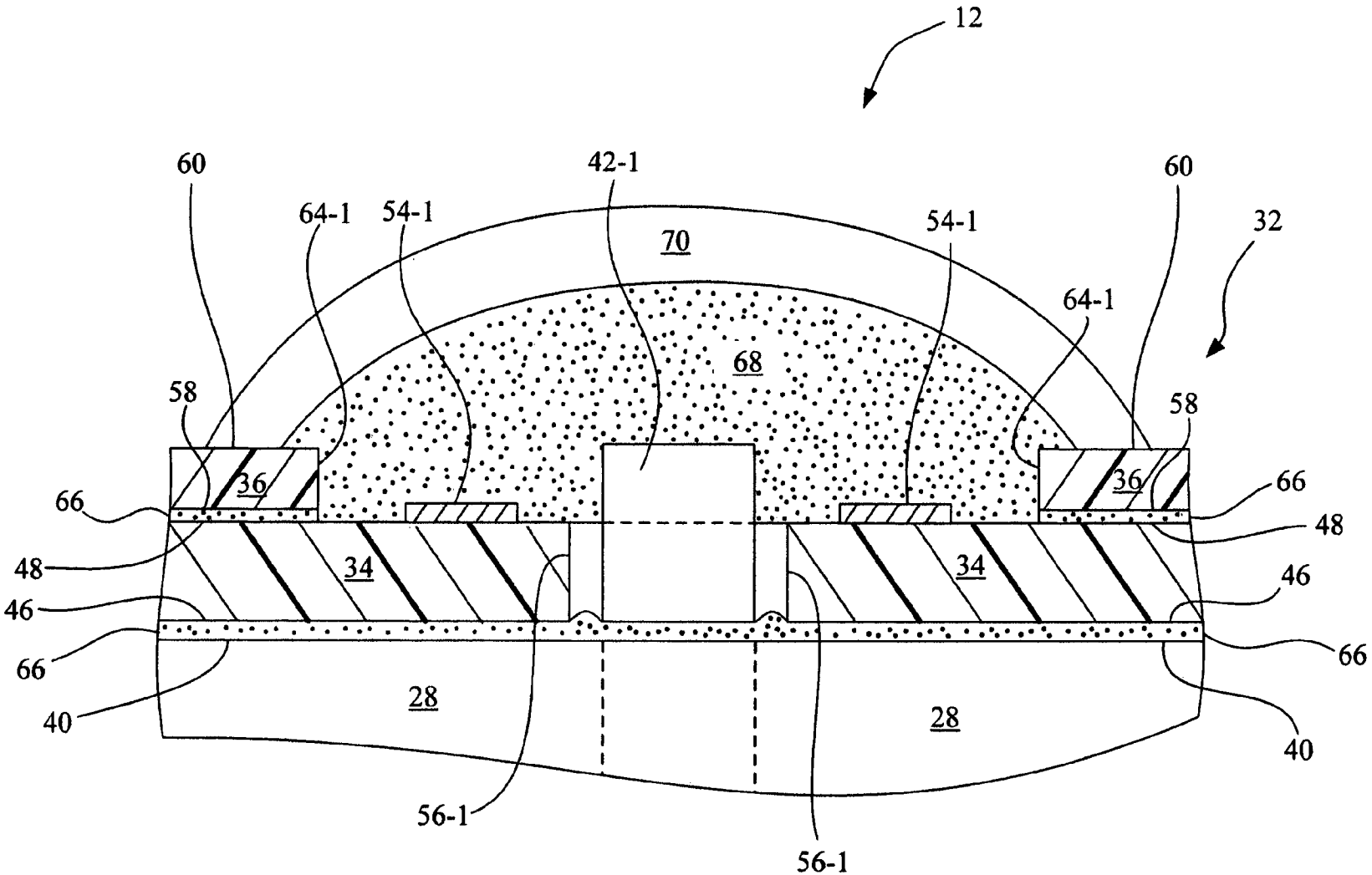
FIG. 7 is a partial sectioned side view of a portion of the ink jet printhead cartridge in accordance with an embodiment of the present invention.

Referring to the embodiment of FIG. 7, printhead 32 may be pre-formed, if desired, by connecting base surface 58 of nozzle plate 36 to the face surface 48 of ink jet chip 34. Referring also to FIGS. 5 and 6, ink jetting nozzle(s) 62 is positioned to be in fluid communication with ink channel 50 of ink jet chip 34. Base surface 58 of nozzle plate 36 may be connected to the face surface 48 of ink jet chip 34, for example, using a sealing adhesive 66, such as a heat activated adhesive, which is positioned to surround ink jetting nozzle 62. A bead of sealing adhesive 66 is also placed between seal surface 40 of body 28 and mounting surface 46 of ink jet chip 34 to sealably attach ink jet chip 34 to seal surface 40 of body 28, and thus mount printhead 32 to body 28.

During assembly, each electrode 42-1, 42-2 of the plurality of electrodes 42 molded with, or attached to, plastic body 28 is positioned to pass through a respective passageway 56-1, 56-2 of the plurality of passageways 56 of ink jet chip 34, and is received into a respective opening 64-1, 64-2 of the plurality of openings 64 of nozzle plate 36. In one embodiment, as shown for example in FIG. 5, each of contact pads 54-1, 54-2 of the plurality of electrical contact pads 54 will surround a respective electrode 42-1, 42-2 of the plurality of electrodes 42.

As illustrated in FIG. 7 with respect to electrode 42-1, each of electrodes 42-1, 42-2 of the plurality of electrodes 42 are electrically connected to a respective contact pad 54-1, 54-2 of the plurality of electrical contact pads 54 at face surface 48 of ink jet chip 34 by a conductive bonding material 68, such as a conductive adhesive, or alternatively, solder. For example, where conductive bonding material 68 is a conductive adhesive, the conductive adhesive may be applied into each of the plurality of openings 64 in nozzle plate 36 to electrically connect each electrode 42-1, 42-2 of the plurality of electrodes 42 to a respective contact pad 54-1, 54-2 of the plurality of electrical contact pads 54 at face surface 48 of ink jet chip 34. The conductive adhesive may extend over a portion of nozzle plate 36, if desired. Thereafter, an insulating encapsulant 70 is formed over the conductive bonding material 68, and may extend over a portion of outer surface 60 of nozzle plate 36. Insulating encapsulant 70 may be, for example, a UV curable encapsulant.

Once assembled, and referring again to FIGS. 2-5, ink reservoir 38 formed in body 28 is connected in fluid communication with ink jetting nozzle 62 of nozzle plate 36 via ink channel 50 of ink jet chip 34, and electrodes 42-1, 42-1 are electrically connected to actuator 52 of ink jet chip 34.

As described above, one skilled in the art will recognize that the ink jetting assembly of ink jet printhead cartridge 12 may be configured as a unitary replaceable ink jet printhead cartridge. Also, one skilled in the art will recognize that an ink jetting assembly may be formed by installing, replaceably or permanently, ink jet printhead cartridge 12 in barrel portion 14 of writing instrument 10, wherein control circuit 16 then is communicatively coupled to the plurality of electrodes 42 via communications link 22 for operating ink jet chip 34 to selectively expel ink from ink jetting nozzle(s) 62 when an input signal is provided to processor unit 24 by input unit 26.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jetting assembly, comprising:

a body;

an ink jet chip attached to said body, said ink jet chip having:

a mounting surface;

a face surface;

an ink channel extending to said face surface;

at least one actuator associated with said ink channel, said at least one actuator including a plurality of electrical contact pads formed on said face surface; and a plurality of passageways extending through said ink jet chip from said mounting surface to said face surface; and a plurality of electrodes, each of said plurality of electrodes passing through a respective passageway of said plurality of passageways and being electrically connected to a respective contact pad of said plurality of electrical contact pads at said face surface.

2. The ink jetting assembly of claim 1, wherein each electrode of said plurality of electrodes is electrically connected to said respective contact pad of said plurality of electrical contact pads by a conductive bonding material.

3. The ink jetting assembly of claim 2, wherein each contact pad of said plurality of electrical contact pads surrounds a respective electrode of said plurality of electrodes.

4. The ink jetting assembly of claim 2, further comprising an insulating encapsulant formed over said conductive bonding material.

5. The ink jetting assembly of claim 1, further comprising:

a nozzle plate having at least one ink jetting nozzle, a base surface, an outer surface, and a plurality of openings extending through said nozzle plate from said base surface to said outer surface, each of said plurality of electrodes being received in a respective opening of said plurality of openings; and a conductive bonding material applied into each of said plurality of openings to electrically connect each electrode of said plurality of electrodes to a respective contact pad of said plurality of electrical contact pads at said face surface of said ink jet chip.

6. The ink jetting assembly of claim 5, further comprising an insulating encapsulant formed over said conductive bonding material and a portion of said outer surface of said nozzle plate.

7. The ink jetting assembly of claim 1, further comprising a nozzle plate having a base surface and at least one ink jetting nozzle, said base surface being attached to said face surface of said ink jet chip, and said at least one ink jetting nozzle being in fluid communication with said ink channel of said ink jet chip.

8. The ink jetting assembly of claim 7, further comprising an ink reservoir formed in said body and connected in fluid communication with said at least one ink jetting nozzle.

9. The ink jetting assembly of claim 8, said ink jetting assembly being configured as a unitary replaceable ink jet printhead cartridge.

10. The ink jetting assembly of claim 8, further comprising a control circuit communicatively coupled to said plurality of electrodes for operating said ink jet chip to selectively expel ink from said at least one ink jetting nozzle, said ink jetting assembly being configured as a writing instrument.

11. The ink jetting assembly of claim 1, further comprising a plastic body forming an ink reservoir and having a seal surface, said plurality of electrodes being molded with said plastic body and extending from said seal surface, said mounting surface of said ink jet chip being coupled to said seal surface of said plastic body with a sealing adhesive.

12. The ink jetting assembly of claim 1, wherein said plurality of electrodes are initially formed as an interconnected lead frame that is molded with said body, and said plurality of electrodes are separated into individual electrodes following said molding.

13. An ink jetting assembly, comprising:

a plastic body forming an ink reservoir and having a seal surface;

an ink jet chip having:

a mounting surface coupled to said seal surface of said plastic body;

a face surface;

an ink channel extending to said face surface;

at least one actuator associated with said ink channel, said actuator including a plurality of electrical contact pads formed on said face surface; and a plurality of passageways extending through said ink jet chip from said mounting surface to said face surface;

a nozzle plate having a base surface, an outer surface, and at least one ink jetting nozzle, said base surface being attached to said face surface of said ink jet chip, and said at least one ink jetting nozzle being in fluid communication with said ink channel of said ink jet chip, said nozzle plate having a plurality of openings extending through said nozzle plate from said base surface to said outer surface; and a plurality of electrodes, each of said plurality of electrodes passing through a respective passageway of said plurality of passageways of said ink jet chip, and each of said plurality of electrodes being received in a respective opening of said plurality of openings of said nozzle plate; and a conductive bonding material applied into each of said plurality of openings to electrically connect each electrode of said plurality of electrodes to a respective contact pad of said plurality of electrical contact pads at said face surface of said ink jet chip.

14. The ink jetting assembly of claim 13, further comprising an insulating encapsulant formed over said conductive bonding material and a portion of said outer surface of said nozzle plate.

15. The ink jetting assembly of claim 13, wherein said plurality of electrodes are molded with said plastic body and extend from said seal surface of said plastic body.

16. The ink jetting assembly of claim 13, wherein said plurality of electrodes are initially formed as an interconnected lead frame that is insert molded with said plastic body, and said plurality of electrodes are separated into individual electrodes following said molding.

17. The ink jetting assembly of claim 13, said ink jetting assembly being configured as a unitary replaceable ink jet printhead cartridge.

18. The ink jetting assembly of claim 13, further comprising a control circuit communicatively coupled to said plurality of electrodes for operating said ink jet chip to selectively expel ink from said at least one ink jetting nozzle, said ink jetting assembly being configured as a writing instrument.

* * * * *